US009540929B2

(12) United States Patent
Aulisio et al.

(10) Patent No.: US 9,540,929 B2
(45) **Date of Patent: *Jan. 10, 2017**

(54) APPARATUS AND METHOD FOR STORING WASTE MATERIAL

(71) Applicants: George Anthony Aulisio, Lakeland, FL (US); Leander Francis Aulisio, Lakeland, FL (US)

(72) Inventors: George Anthony Aulisio, Lakeland, FL (US); Leander Francis Aulisio, Lakeland, FL (US)

( * ) Notice: Subject to any disclaimer, the term of this patent is extended or adjusted under 35 U.S.C. 154(b) by 77 days.

This patent is subject to a terminal disclaimer.

(21) Appl. No.: 14/121,907

(22) Filed: Oct. 31, 2014

(65) Prior Publication Data

US 2015/0097413 A1 Apr. 9, 2015
US 2015/0322788 A9 Nov. 12, 2015

Related U.S. Application Data

(63) Continuation of application No. 13/815,981, filed on Mar. 20, 2013, now Pat. No. 8,882,204.

(51) Int. Cl.
*B09B 1/00* (2006.01)
*E21F 15/00* (2006.01)
(Continued)

(52) U.S. Cl.
CPC ..... *E21F 15/00* (2013.01); *E21B 7/046* (2013.01); *E21B 43/00* (2013.01); *E21C 27/22* (2013.01);
(Continued)

(58) Field of Classification Search
CPC ..... E21F 15/00
See application file for complete search history.

(56) References Cited

U.S. PATENT DOCUMENTS 3,458,235 A 7/1969 Rinio et at
3,625,567 A 12/1971 Blumenthal et al.
(Continued)

FOREIGN PATENT DOCUMENTS

CN 1053104 7/1991
EP 1555 98 A2 9/1985
GB 1414221 11/1975

OTHER PUBLICATIONS

International search report, Apr. 27, 2011, International Application No. PCT/US 11/00270; applicant: George Anthony Aulisio.
(Continued)

*Primary Examiner* — John Kreck
(74) *Attorney, Agent, or Firm* — Leander F. Aulisio

(57) ABSTRACT

The present invention relates to a method of storing waste material in a subterranean formation, the method including digging a mine shaft to reach the subterranean formation; constructing a ventilated underground control center wherein the center includes a computerized control panel; providing a drill head, wherein the computerized control panel controls the movements of the drill head; providing a hollow drill pipe; providing a movable hydraulic shield; providing a movable resin roof bolting machine; providing a movable waste extrusion device; operating the computerized control panel to advance the drill head into the subterranean formation to obtain a mined-out space; and extruding waste material into the mined-out space of the subterranean formation.

8 Claims, 2 Drawing Sheets

(51) Int. Cl.

| | |
|---|---|
| ***E21C 37/16*** | (2006.01) |
| ***E21C 41/16*** | (2006.01) |
| ***E21B 43/00*** | (2006.01) |
| ***E21C 27/22*** | (2006.01) |
| ***E21C 41/18*** | (2006.01) |
| ***E21F 13/04*** | (2006.01) |
| ***E21F 15/06*** | (2006.01) |
| ***E21B 7/04*** | (2006.01) |
| ***E21C 41/32*** | (2006.01) |

(52) U.S. Cl.
CPC ..... *E21C 37/16* (2013.01); *E21C 41/16* (2013.01); *E21C 41/18* (2013.01); *E21C 41/32* (2013.01); *E21F 13/042* (2013.01); *E21F 15/06* (2013.01)

(56) References Cited

U.S. PATENT DOCUMENTS

| | | | | |
|---|---|---|---|---|
| 3,712,677 | A | 1/1973 | Janssen | |
| 3,797,590 | A | 3/1974 | Archibald et al. | |
| 3,892,442 | A | 7/1975 | Janssen | |
| 3,907,366 | A | 9/1975 | Pender | |
| 3,924,895 | A | 12/1975 | Leasure | |
| 4,010,801 | A | 3/1977 | Terry | |
| 4,023,862 | A | 5/1977 | Gold | |
| 4,304,308 | A | 12/1981 | Munding et al. | |
| 4,305,620 | A | 12/1981 | Hart et al. | |
| 4,330,155 | A | 5/1982 | Richardson et al. | |
| 4,378,132 | A | 3/1983 | Spies et al. | |
| 4,402,371 | A | 9/1983 | Rochetti | |
| 4,625,631 | A | 12/1986 | Vera | |
| 4,699,429 | A | 10/1987 | Maybrier et al. | |
| 4,753,484 | A | 6/1988 | Stolarczyk et al. | |
| 4,754,142 | A | 6/1988 | Cooper et al. | |
| 5,161,857 | A | 11/1992 | Mayercheck et al. | |
| 5,366,030 | A | 11/1994 | Pool, II et al. | |
| 5,419,405 | A | 5/1995 | Patton | |
| 5,667,279 | A | 9/1997 | Christopher et al. | |
| 5,879,057 | A | 3/1999 | Schwoebel et al. | |
| 6,612,655 | B2 | 9/2003 | Schwoebel et al. | |
| 6,633,252 | B2 | 10/2003 | Stolarczyk et al. | |
| 6,666,521 | B1 | 12/2003 | Pease | |
| 6,688,702 | B1 | 2/2004 | Abramov et al. | |
| 6,755,480 | B2 | 6/2004 | Sult et al. | |
| 6,791,469 | B1 | 9/2004 | Rao et al. | |
| 7,207,632 | B2 | 4/2007 | Lowery | |
| 8,262,167 | B2 * | 9/2012 | Aulisio | E21B 7/046 299/18 |
| 8,408,658 | B2 * | 4/2013 | Aulisio | E21B 7/046 299/18 |
| 8,882,204 | B2 * | 11/2014 | Aulisio | E21C 37/16 299/14 |
| 2002/0113484 | A1 | 8/2002 | Schwoebel et al. | |
| 2002/0185906 | A1 | 12/2002 | Stolarczyk | |
| 2003/0038526 | A1 * | 2/2003 | Drake | E21B 7/002 299/18 |
| 2003/0131989 | A1 | 7/2003 | Zakiewicz | |
| 2003/0201098 | A1 | 10/2003 | Karanikas et al. | |
| 2004/0033557 | A1 | 2/2004 | Scott et al. | |
| 2004/0070257 | A1 | 4/2004 | Drake et al. | |
| 2004/0262980 | A1 * | 12/2004 | Watson | E21B 43/29 299/8 |
| 2005/0013672 | A1 | 1/2005 | Slater | |
| 2005/0067879 | A1 | 3/2005 | Burgess et al. | |
| 2005/0103527 | A1 | 5/2005 | Church et al. | |
| 2006/0005972 | A1 | 1/2006 | Rusby et al. | |
| 2006/0248875 | A1 | 11/2006 | Maganas | |
| 2009/0133730 | A1 | 5/2009 | McVey | |

OTHER PUBLICATIONS

Holman, Darren W. ,Development of an Underground Automated Thin-Seam Mining Method, Thesis submitted to the Faculty of the Virginia Polytechnic Institute and State University, May 10, 1999, Blacksburg, Va.

* cited by examiner

APPARATUS AND METHOD FOR STORING WASTE MATERIAL

The present application is a continuation application based on U.S. patent application Ser. No. 13/815,981, filed on Mar. 20, 2013, now U.S. Pat. No. 8,882,204; which is a continuation-in-part application based on U.S. patent application Ser. No. 13/573,099, filed on Aug. 21, 2012, now U.S. Pat. No. 8,408,658; which is a divisional application based on U.S. patent application Ser. No. 12/805,703, filed on Aug. 16, 2010, now U.S. Pat. No. 8,262,167; which is a non-provisional application based on Provisional U.S. Patent Application Ser. No. 61/272,142, filed on Aug. 20, 2009.

BACKGROUND OF THE INVENTION

The present invention is dedicated to Georgio Aulisio. He boarded ship from his native Italy and arrived at Ellis Island in the Harbor of New York City in the late $19^{th}$ century at the age of sixteen. He had six dollars in his pocket. During his lifetime, he was employed in the anthracite coal mines of eastern Pennsylvania.

Prior art methods of mining coal include surface mining and underground mining. In surface mining, a seam of coal located close to the surface of the earth is first exposed by mechanical removal of the earth above the coal seam. A mountaintop, for example, can be removed by employing bulldozers and earthmoving equipment to expose an underground seam of coal. The exposed seam of coal is mined by employing machinery known to one of ordinary skill in the art.

Underground mining includes sinking a shaft into the earth near (or into) a seam of coal. A ventilated area is then constructed within the seam of coal. Ventilation of the underground area allows coal miners to operate mechanical equipment at the face of a coal seam. The coal is then brought to the surface. A preferred method of removing coal from the coal face is the long-wall method of mining. Regardless of the method employed in underground mining, conditions for the miners are very dangerous. Although various safety precautions are taken with regard to the underground mining of coal, accidents occur on a regular basis.

One problem in underground mining of coal is the presence of methane gas in the coal seam. A coal seam is naturally infused with substantial amounts of methane. Methane is the most highly reduced form of carbon, which means that it readily undergoes rapid oxidation. It forms an explosive mixture with oxygen (air). Methane has an upper explosive limit and a lower explosive limit. The upper explosive limit (UEL) for methane is about 15% by volume. The lower explosive limit (LEL) for methane is about 5% by volume. Traditional underground mining operates in a region below the lower explosive limit of methane. Conditions in an underground mine can be monitored by employing a "bug lamp". The "bug lamp" burns with a bright yellow flame when the composition of the atmosphere at the face of a coal seam is such that it is below the LEL of methane. When the "bug lamp" burns with a blue cap above the yellow flame, the underground atmosphere is above the LEL of methane. This signifies extremely dangerous conditions. Ventilation with above-ground air is immediately increased to remove the dangerous conditions. Mining operations cease when the atmospheric condition in the underground mine is above the LEL of methane.

SUMMARY OF THE INVENTION

The present invention relates to a novel method for mining underground coal. The earth is not stripped away from the coal seam. The method comprises mining of underground coal that is deep within the crust of the earth. Coal seams as deep as a half mile or more can be mined by employing the method of the present invention. The hazards of traditional underground mining, such as the long-wall method of mining coal, are substantially reduced or even eliminated. A safe and efficient method of mining underground coal, preferably coal that is located deep underground, is hereby disclosed.

In an embodiment, the present method includes locating a seam of coal under the surface of the earth, and sinking a main shaft within the seam of coal. An underground control center is then constructed adjacent to the main shaft. The underground control center is within the seam of coal. The underground control center can be a box-like, rectangular shaped structure. In order to ventilate the underground control center, a ventilation system is constructed. The ventilation system includes a ventilation unit, a ventilation fan and a ventilation shaft. The ventilation fan is located on the surface of the earth. The ventilation unit is located inside the underground control center, and supplies fresh air from the ventilation fan to the underground control center. The ventilation shaft connects the above-ground ventilation fan with the underground ventilation unit. The ventilation shaft contains a first passageway and a second passageway. The first passageway supplies fresh air from above the ground to the underground control center; and the second passageway removes polluted air from the underground control center and releases it to the atmosphere above the ground. If the underground control center is in the shape of a box-like, rectangular unit, then the rectangular unit can have dimensions such as 150 feet long, 120 feet wide and 30 feet high.

The underground control center contains a computerized control panel. The computerized control panel is operatively connected to a first power source and a second power source. Two types of power that can be employed in the underground setting of the coal mine are hydraulic power and electric power. The first power source is further connected to a drill head. The second power source is further connected to a movable hydraulic shield and a movable waste extrusion unit. Electric wires or electric cables can be employed as the electrical connections between the computerized control panel and the various pieces of movable equipment such as the movable hydraulic shield and the movable waste extrusion unit. The drill head is operatively connected to the first power source by a hollow, extendable drill shaft. The hollow drill shaft allows mined coal to pass through the shaft and ultimately be collected at the surface of the earth. In an embodiment, mined coal passes through a mesh filter to discard larger pieces of coal before entering the hollow drill shaft. Preferably, the mesh filter is located directly behind the drill head. After discarding larger pieces of coal, a fluid is added to the remaining coal to obtain coal particles suspended in a dispersion or slurry. A pump is employed to move the coal dispersion or slurry through the hollow drill shaft and toward the underground control center. The pump is operatively connected to the computerized control panel. In an embodiment, the pump is located within the underground control center. The slurry is passed through the hollow, extendable drill shaft in the opposite direction of the advancing drill head. Depending on the speed of advance of the drill head, the pumping operation can be continuous or intermittent. When the pumping operation allows flow of dispersed coal particles at a speed faster than that of the advancing drill head, then the pumping operation can be continuous. Otherwise, the drilling operation is stopped, and the pumping of the coal particles occurs in a discontinuous fashion. Mining personnel in the underground control center operate the computerized control panel to both advance the drill head into the coal seam and advance the coal dispersion or slurry toward the underground control center. The control center also functions as a storage room for all of the needed mining equipment such as extendable pipes, drill heads, extrusion units, connection devices, electrical units, electrical cables and wires, roof bolts, hydraulic shields, resin roof bolting machines, maintenance equipment and the like. Apparatus that follows behind the advancing drill head in the coal seam is herein referred to as "movable equipment". Movable equipment comprises a movable hydraulic shield, a movable resin roof bolting machine, and a movable waste extrusion unit. In an embodiment, the movable pieces of equipment, such as the movable hydraulic shield, the movable resin roof bolting machine and the movable waste extrusion' unit, can employ the hollow, extendable drill shaft as a "track" to control the direction of their forward progress. The movable extrusion unit allows mining personnel in the underground control center to fill the void space of the coal seam (the mined-out volume of the coal seam) with used rubber tires and other types of waste. This filling of the void space also has the advantage of preventing subsidence in the mine.

DETAILED DESCRIPTION OF THE INVENTION

Figure 1:
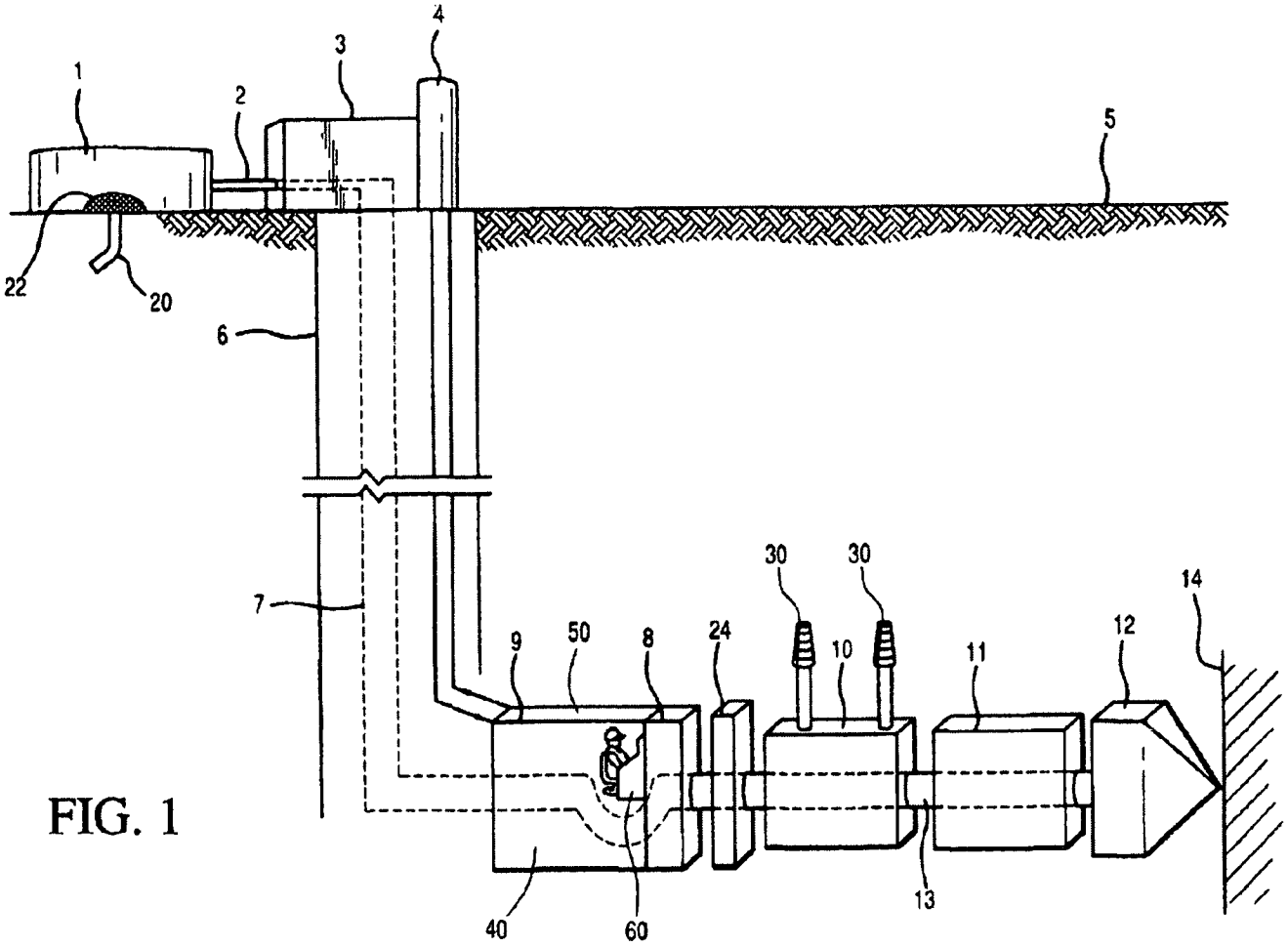
FIG. 1 is a representation of an embodiment of the present invention wherein an underground operations center is employed to mine coal in a robotic fashion.

Many seams of coal are located within the crust of the earth. The coal seams can be very deep within the crust. The geological construct of the crust can be represented as a compilation of layers of materials, one on top of the other. Within the center of the earth is hot liquid magma. Surrounding the center of hot magma is the crust. Within the crust, coal seams alternate with layers of rock and the like. It is not uncommon for coal seams to be located one above the other, with a layer of rock in-between any two seams. For example, in the Western Pennsylvania/West *Virginia* region of the United States of America, coal mining operations have been conducted in a seam of coal known as "Pittsburgh #8". This means that there are seven seams of coal above the "Pittsburgh #8" seam. Seams of coal are also located below "Pittsburgh #8".

Coal seams are designated as "high seam" coal or "low seam" coal. "Low seam" coal is usually about a few inches in depth to about eight feet in depth. High seam coal is greater than about eight feet to about fifty-five feet in depth, or even thicker. By "depth" of the coal seam is meant the distance from the top of the seam of coal to the bottom of the seam of coal. The present invention can be employed to mine both "high seam" coal and "low seam" coal. The method of the present invention can be employed to mine "rooster" coal, which can have a depth of only about a few inches up to about a few feet.

Coal seams are located by means of well-known geological surveying methods. Methods of location of underground seams of coal are well-known in the art and, as such, form no part of the present invention. It is to be understood that location of specific seams of coal can be readily accomplished, and, as such, form no barrier to the practice of methods of the present invention.

In an embodiment, the method of the present invention includes locating a seam of coal under the surface of the earth, and sinking a main shaft substantially within the seam of coal. An underground control center is then constructed substantially adjacent to the mine shaft and within the seam of coal. The control center comprises a ceiling section, a plurality of walls depending from the ceiling section and a floor section for receiving the walls. Roof bolts are employed to stabilize the ceiling section of the control center. Any number of walls can be used, thus giving various shapes to the control center. Preferably four walls are employed. In an embodiment, the underground control center is rectangular in shape.

A ventilation system containing a ventilation unit, a ventilation fan and a ventilation shaft is employed to ventilate the underground control center. The ventilation fan is located on the surface of the earth. The ventilation unit is located inside the underground control center, and supplies fresh air to the underground control center. The unit also removes stale air from the control center. The ventilation shaft connects the above-ground ventilation fan with the underground ventilation unit. In an embodiment of the present invention, the ventilation shaft is constructed such that it is substantially parallel with the main shaft. The ventilation shaft supplies fresh air from above ground to the underground control center. The ventilation fan drives air from above the ground into the ventilation shaft. In an embodiment, the ventilation shaft contains a first passageway and a second passageway. The first passageway supplies fresh air from above the ground to the underground control center. The second passageway removes polluted air from the underground control center. The ventilation system of the present invention is substantially smaller than ventilation systems of all prior art underground mining operations. This is because the coal face is not ventilated. Only the underground control center is ventilated with breathable air.

Mining personnel reach the underground control center by means of an elevator system that is located within the main shaft. The number of underground mining personnel is greatly reduced in the present invention. Preferably, less than ten personnel are employed in the method of the present invention. More preferably, about four or five mining personnel are employed. Most preferably, one or two mining personnel occupy the underground control center. Mining personnel occupying the underground control center perform tasks, such as mining coal and extruding waste, in an extremely safe underground environment.

The underground control center contains a computerized control panel. The control panel is operatively connected to a first power source and a second power source. A drill head is operatively connected to the first power source by means of a hollow, extendable drill shaft. In an embodiment, the drill head is a tri-cone drill head. The first power source is an electric motor, a jet engine, a fuel cell or a combustion engine. The first power source drives the drill head into the underground seam of coal. In an embodiment, coal is collected at a collection zone located immediately behind the advancing drill head. The collection zone directs aggregate coal into the hollow drill shaft for transfer to the underground control center, and eventually to the coal collection unit located above-ground. In an alternative embodiment, the rotating drill head contains a hollow passageway in the center of the drill head. Aggregate coal is drawn into the hollow passageway. From the hollow passageway in the advancing, rotating drill head, the mined coal enters the hollow, extendable drill shaft for transfer to the underground control center, and eventually to the coal collection unit located above-ground.

In an embodiment, the drill head rotates at a speed that is faster than the rotational speed of cutting blades of traditional mining operations. In prior art methods of mining underground coal, the cutting machines operate at a relatively slow speed, almost like a grinding speed. The rotational speed of the drill head in the present invention is about 500 rpm to about 5000 rpm, or even higher. It is within the scope of the present invention to mine coal as quickly as possible by shooting the drill head through the seam of coal. In an embodiment of the present invention, this "high speed coal mining" can be accomplished by employing a jet engine as the first power source. Mining of the underground coal seam proceeds in an extremely safe environment because the actual mining operation is conducted in an underground atmosphere that is substantially above the UEL for methane.

In an alternative embodiment, the drill head is replaced by a "hot head" device that can burn through the coal seam. A "hot head" is presently defined as a piece of machinery that "burns" the coal from the coal seam. In an embodiment, the present invention can employ the method of conversion of coal in situ as disclosed in U.S. Pat. No. 4,776,638 (Hahn), wherein coal is vaporized at the face of the coal seam by employing a mixture of air, steam, an electrolyte and a suitable carrier. The mixture is sprayed directly on the coal seam through a passage in a nozzle. The probe is also energized with electricity applied to the nozzle. An arc is produced between the coal and the probe simultaneous with the spraying of the mixture on the coal seam. Vaporized coal is then readily pumped to the surface of the earth for further transport. U.S. Pat. No. 4,776,638 is incorporated herein by reference in its entirety. In an alternative embodiment, a plasma apparatus such as a plasma torch can be employed at the drill head to pyrolyze the coal at the face. In yet another alternative embodiment, coal can be liquefied in situ in accordance with a method disclosed in U.S. Pat. No. 3,973,628, issued to Colgate, and assigned on the face to New Mexico Tech Research Foundation. The method includes: supplying a hydrogenating solvent for the coal to a coal seam, and maintaining the solvent in the coal seam at a temperature of from about 300 degrees C. to about 500 degrees C. at a pressure of from about 100 atmospheres to about 500 atmospheres. U.S. Pat. No. 3,973,628 is incorporated herein by reference in its entirety. A machine for vaporizing the coal, herein referred to as a "hot head" device is well known to one of ordinary skill in the art and, as such, forms no part of the present invention. It is within the scope of the present invention to employ a combination of drill head(s) and "hot head" device(s). It is further within the scope of the present invention to employ a combination of various "hot head" devices.

Coal mined by the drill head is passed through a mesh filter to discard larger pieces of coal. In an embodiment, the mesh filter is located at the distal part of the extendable, hollow drill shaft, and immediately behind the drill head. The extendable, hollow drill shaft has a proximal end, located within the underground control center; and a distal end, located immediately behind the drill head. The distal end is farthest from the underground control center. In an embodiment, the mesh filter has a mesh size that rejects coal pieces larger than about ½ inch in diameter. In an alternative embodiment, the mesh filter has a mesh size that rejects coal pieces larger than about 12 inches in diameter. A mesh size anywhere within the range of about ½ inch to about 12 inches is acceptable. It is within the scope of the present invention to employ more than one mesh filter at the distal end of the extendable, hollow drill shaft. It is also within the scope of the present invention to operate without the use of such a mesh filter; as the mining action of the advancing drill head, under various circumstances, crushes the coal particles to a size adequate for slurry transport.

In an embodiment, the pieces of coal are combined with a fluid. The fluid can be any material, liquid or gas, used for transporting particles of coal. The mixture of coal and fluid forms a dispersion or slurry of coal particles. In an embodiment, the fluid is water. In another embodiment, the fluid is air. The dispersion or slurry is pumped through the extendable, hollow drill shaft towards the underground control center. When the slurry reaches the underground control center, it is transported to the surface of the earth. A pump or a series of pumps allows the coal particles to be transported to the surface of the earth.

In an embodiment, a directing means for advancing the drill head in a desired direction is employed. The directing means allows the drill head to stay within the coal seam as the drill head cuts a substantially circular hole in the seam. The directing means also avoids the possibility of the drill head cutting through rock or other geological material. The directing means is operatively connected to the computerized control panel in the underground control center. In an embodiment, the directing means is located directly behind the advancing drill head. A directing means is known to one of ordinary skill in the art, and, as such, forms no part of the present invention.

In an embodiment, the directing means comprises an optical fiber. The optical fiber allows mining personnel in the underground control center to monitor the progress of the drill head. It also allows the mining personnel to adjust the forward direction of the drill head, providing a favorable path through the crust of the earth.

The hollow, extendable drill shaft allows aggregate coal (the mined coal) to be removed from the coal face and transferred to the surface of the earth. The mined coal is then removed to an above-ground collection unit.

Mining personnel in the underground control center operate the computerized control panel to control the drill head and mine coal. The first power source that drives the drill head and advances it through a coal seam is an electric motor, a combustion engine, a fuel cell, or a jet engine. In a preferred embodiment, the first power source is a jet engine. Mining personnel working in the underground control center are protected from the severe noise of the jet engine by sound-proofing means such as a noise barrier for sound control. Sound-proofing means are known to one of ordinary skill in the art, and, as such, form no part of the present invention.

A stationary first hydraulic shield is placed between the underground control center and the face of the coal seam. In a preferred embodiment, the first hydraulic shield is located at a position about five feet to about fifty feet in front of the underground control center. By the "front" of the underground control center is meant the side of the control center that faces the advancing drill head(s). In an embodiment, a sump area is located between the stationary first hydraulic shield and the underground control center, or within the underground control center. The sump area is employed to adjust the composition of the recovered material (solids, liquids or gas) prior to pumping the recovered material to the surface of the earth. Adjustment of the composition includes: dewatering, suspending, separating, and/or concentrating of materials withdrawn from the mined-out hole.

It is within the scope of the present invention to have multiple "fronts" for the underground control center, as multiple drill heads can be advancing outwardly in a radial fashion from one underground control center. The stationary first hydraulic shield protects the operations center from various materials either employed or generated during the mining operation. The materials can be liquids, solids or gases. Examples of such materials are methane, slurry water, cooling water for the drill head(s), carbon monoxide and large pieces of coal and rock. The stationary first hydraulic shield remains in place during the entire mining operation. Hydraulic shields are known to one of ordinary skill in the art and, as such, form no part of the present invention.

A second hydraulic shield is movable. By "movable" is meant that the shield advances behind the drill head. It stabilizes the drilling area. The second hydraulic shield also assists in supporting the roof bolts that are placed in the roof of the mine. By "mine" is meant the substantially circular opening that is formed by the advancing drill head. The second hydraulic shield also stabilizes the drill head. Further, the second hydraulic shield acts as an effective barrier against methane. In an alternative embodiment, a plurality of movable hydraulic shields is employed. Preferably, three to four movable hydraulic shields are employed to further protect the operations center from methane gas and the like.

A movable resin roof bolting machine is placed between the drill head and the underground control center. By "movable" is meant that the resin roof bolting machine advances behind the drill head. The resin roof bolting machine stabilizes the mined out area behind the advancing drill head. The resin roof bolting machine, in a first step, applies resin to the roof of the mined out section of the coal seam. By "mined out section" is meant the substantially circular opening that is formed by the advancing drill head. The movable resin roof bolting machine, in a second step, sinks roof bolts into the resin-coated coal. The roof of the mine (mined out section) is thus stabilized. The movable resin roof bolting machine contains at least one drill which drives bolts into the roof of the mine behind the advancing drill head.

In an embodiment, the order of equipment advancing through the coal seam is: drill head, resin roof bolting machine and second movable hydraulic shield. In an alternative embodiment, the order of advancing equipment is: drill head, second movable hydraulic shield and resin roof bolting machine.

In an embodiment, mining personnel in the underground control center operate the computerized control panel to advance the drill head and the movable equipment through the coal seam.

In an embodiment, an extrusion system is employed. The extrusion system contains an above-ground waste disposal unit, a hollow transfer pipe and a movable extrusion device. The extrusion device is located underground and is connected to the above-ground waste disposal unit by the hollow transfer pipe. It advances behind the movable resin roof bolting machine, the movable second hydraulic shield and the drill head. The movable extrusion device is operatively connected to the second power source wherein the second power source is operatively connected to the computerized control panel. In an embodiment, the extrusion device is connected to the second power source by electrical means. Electrical means are electric wires and electric cables. By operating the computerized control panel, mining personnel control the advancement of the movable extrusion device. In an embodiment, the movable extrusion device can employ the hollow, extendable drill shaft as a "track" to control the direction of the forward progress of the extrusion device.

In an embodiment, the above-ground waste disposal unit is located at a proximal distance to the entrance of the main shaft. By "proximal distance" is meant a distance of about a hundred yards to about five hundred yards. Waste material is deposited in the waste disposal unit. Waste material can be bio-medical waste, used tires, landfill waste, slaughterhouse waste, municipal waste, low grade nuclear waste, biodegradable waste or mixtures thereof. In a preferred embodiment, the waste is discarded rubber tires. The waste disposal unit optionally contains a compaction device for compacting waste material.

In an embodiment, discarded rubber tires are sheared before they are deposited into the above-ground waste disposal unit. A shearing device is located adjacent to the waste disposal unit. The shearing device is employed to shear the discarded rubber tires. The sheared tires are transported from the above-ground waste disposal unit, through the hollow transfer pipe to the underground movable extrusion device. Shearing devices are known to one of ordinary skill in the art and, as such, form no part of the present invention.

In an alternative embodiment, the shearing device is located in the underground control center. Discarded tires are transported from the above-ground waste disposal unit to the underground shearing device by means of the hollow transfer pipe. Once under the ground, the discarded tires are sheared. They are transported to the movable extrusion device by a transfer means. The transfer means can be a movable belt assembly, a hollow conduit, a spray gun or the like. In an alternative embodiment, discarded tires are treated with liquid nitrogen and then shattered into pieces. It is within the scope of the present invention, to combine the shearing of the discarded tires with the treatment of the discarded tires with liquid nitrogen.

In an embodiment, the movable extrusion device is filled with sheared tires or shattered tires prior to the drilling operation. The extrusion device is stationary while it is being filled. In an alternative embodiment, the extrusion device is continuously filled with sheared tires and the like while it advances behind the train of movable equipment, which includes the drill head, the second hydraulic shield and the resin roof bolting machine. Preferably, a hollow conduit is employed to fill the advancing extrusion device.

In an embodiment, coal is mined outwardly in a radial fashion from an underground control center in multiple directions. A plurality of drill heads is employed for the mining of underground coal in multiple directions.

In an alternative embodiment, coal is mined from the underground control center in only one direction, but with a plurality of drill heads. Each drill head is operatively connected to a hollow, extendable drill shaft. Further, each drill head advances through the seam of coal, mining the coal with each advance, in unison with at least one movable hydraulic shield, at least one movable resin roof bolting machine and at least one movable extrusion device. Preferably, the number of drill heads is about two to about eight. Most preferably, the number of drill heads is three. Various formations are possible for the advancing drill heads, such as a linear array in a vertical or horizontal pattern.

In an embodiment, the drill head penetrates into the seam of coal for a distance of about a quarter mile to about three miles, or even longer. Penetration range is limited only by the mechanical constraints of the mining equipment.

The present invention further relates to a method of reclaiming land that is a land-fill or the like. Surface area on the earth (real estate) is a valuable commodity. As such, it can be reclaimed and used for such commercial enterprises as homebuilding, commercial building construction, farmland, nuclear power plants, wind farms, solar energy plants and the like. By employing methods of the present invention, a large amount or all of the land now used for storing municipal waste in landfills can be recovered for more productive use by removal of the waste material to mined-out regions. Preferably, the mined-out regions are deep within the crust of the earth to avoid problems with pollution of underground water. Automobile junkyards and the like can also be converted to useful property by employing methods of the present invention.

Referring to FIG. 1, a schematic diagram of an underground coal mining operation of the present invention is presented. A coal collection unit 1 is located on the surface of the earth 5. The coal collection unit 1 receives the coal that is mined by the operation. The coal is usually in the form of particles ranging in size from about a few inches in diameter up to about one foot in diameter. If the coal is pulverized, the particles are much less than a few inches in diameter. The above-ground coal collection unit 1 receives the particles of coal dispersed in a slurry. It is within the scope of the present invention to locate at least one drainage ditch 20 in the bottom of the coal collection unit 1. The at least one drainage ditch 20 allows water from the slurry to be removed from the coal particles. The drainage ditch 20 is covered with a fine mesh screen 22. The fine mesh screen 22 prevents particles of coal, including very fine particles of coal, from leaving the coal collection unit 1. Coal removed from underground coal seam 14 is transported through the drill head 12 or behind the drill head 12 and into a slurry unit (not shown). In the slurry unit (not shown), the mined coal is combined with a fluid such as water or gas to form a coal slurry. The coal slurry is removed to the hollow, extendable, rotatable drill shaft 13. From the drill shaft the coal slurry enters the coal slurry pipe 7. The coal slurry is pumped to the surface of the earth, where it passes into the coal slurry pump house 3. Transfer means 2 leads the coal slurry from the coal slurry pump house 3 to the coal collection unit 1.

The coal slurry pump house 3 receives coal slurry from the coal slurry pipe 7. The coal slurry pump house 3 contains at least one pump (not shown). The at least one pump (not shown) draws out the coal slurry from underground by pumping action. The coal slurry pipe 7 transfers the coal slurry from underground to above-ground. Coal slurry pipe 7 is located within a main shaft 6. The main shaft 6 is positioned between the coal slurry pump house 3 and an underground control center 9. The underground control center 9 includes walls 40 and a ceiling 50. A computerized control panel 60 is located within the underground control center 9. The coal slurry travels a recovery path that leads from the coal face 14 to the coal collection unit 1.

A ventilation fan 4 is located above the ground. The ventilation fan 4 removes stale air from the underground control center 9. The ventilation fan 4 also draws fresh air from the atmosphere above the surface 5. Fresh air is then transferred from the above-ground atmosphere to the underground control center 9 by means of a ventilation shaft (not shown). The fresh air is distributed by means of a ventilation unit (not shown) located in the underground control center, allowing mining personnel to work in a safe environment.

A power source 8 drives a drill head 12. In an embodiment, the drill head 12 is a tri-cone drill. The tri-cone drill is useful in both the mining of the coal and in reducing the particle size of the coal. In an embodiment of the present invention, the drill head 12 is hollow in a central portion thereof. This feature of the drill head 12 allows mined coal to be removed to the extendable, hollow drill shaft 13 for transport to the surface of the earth. The drill head 12 is operatively connected to the power source 8 by extendable, rotatable, hollow drill shaft 13. By "extendable" is meant that hollow pieces can be added from the underground control center to the lengthening drill shaft 13, similar to an oil drilling operation.

The drill head 12 bites into a coal seam 14 to mine coal. The drill shaft 13 is a hollow shaft. This allows the mined coal, also known as aggregate coal, to be transferred to the underground control center 9. A first stationary hydraulic shield 24 is located adjacent to the underground control center 9 and the power source 8. A second movable hydraulic shield 11 is located substantially immediately behind the drill head 12. The second movable hydraulic shield 11 follows behind the advancing drill head 12. The second hydraulic shield 11 contains a methane barrier for preventing methane gas from penetrating into the underground control center 9.

In an embodiment, the power source 8 contains a jet engine. The jet engine drives the drill head 12 into the underground coal seam 14 in substantially less time than a standard combustion engine or the like.

A roof resin bolting machine 10 is movable. It travels behind the advancing second hydraulic shield 11. The roof resin bolting machine 10 comprises at least one drill. The drill bolts the roof of the mine. In the bolting operation, a resin composition is first deposited on the overhead surface of the drilled out coal seam. In an embodiment, the drilled out (mined out) coal seam is substantially circular. When viewed in a three dimensional Cartesian space, the mined out area of the coal seam is in the shape of a cylinder. Bolts 30 are then deposited into the resin composition. Finally, the bolts 30 are drilled into the roof of the coal seam. This series of operations prevents collapse of the mine by stabilizing the mined out coal seam. In an embodiment, the roof bolt includes a hollow drill tip bolt with a plurality of holes. The hollow drill-tipped bolt includes a passageway for receiving resin. In operation, the drill-tipped bolt is inserted into the roof, and resin is forced through the plurality of holes to permanently seal the roof of a subterranean formation such as a coal seam.

In an alternative embodiment, the drill head 12 is a high temperature drill head (a "hot head" machine) that gasifies the coal as it is being mined. Such technology is known to one of ordinary skill in the art, and as such forms no part of the present invention. The gasified coal is then readily transported to the surface for storage and ultimate transport.

In an alternative embodiment, the drill head 12 can be operated at a temperature that liquefies the coal as it is being mined. Liquefied coal is then readily removed to the surface for storage and ultimate transport.

Figure 2:
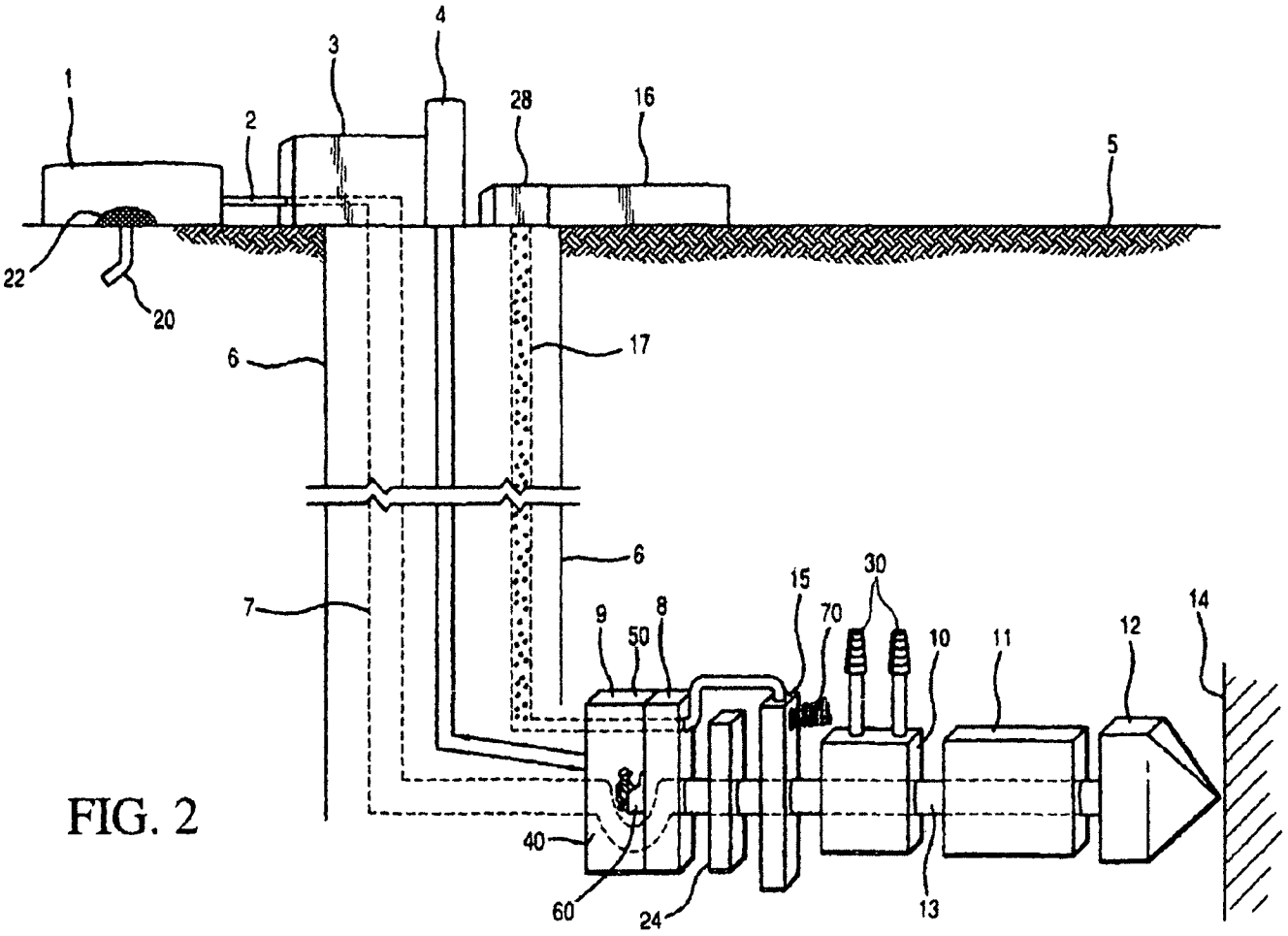
FIG. 2 is a representation of an embodiment of the present invention wherein an extrusion unit fills a mined out section of a coal seam with waste material in a robotic fashion.

Referring to FIG. 2, a schematic diagram of an underground coal mining operation of the present invention, including a waste extrusion system, is presented. A coal collection unit 1 is located on the surface of the earth 5. The coal collection unit 1 receives the coal that is mined. The coal is preferably in the form of particles ranging in size from about a few inches in diameter up to about one foot in diameter. If the coal is pulverized, the particles are much less than a few inches in diameter. The coal collection unit 1 receives the particles of coal in a slurry. The coal travels from underground to above-ground in the coal slurry pipe 7.

A drainage ditch 20 is located in the bottom of the coal collection unit 1. The drainage ditch 20 allows water from the slurry to be removed from the coal particles. The drainage ditch 20 is covered with a fine mesh screen 22. The fine mesh screen 22 prevents particles of coal, including very fine particles of coal, from leaving the coal collection unit 1. Coal removed from underground coal seam 14 is transported through the drill head 12 or behind the drill head 12 and into a slurry unit (not shown). In the slurry unit (not shown), the mined coal is combined with a fluid such as water or the like to form a coal slurry. The coal slurry is removed to the transfer pipe 13 and brought to the surface where it passes through the coal slurry pump house 3. Transfer means 2 leads the coal slurry from the coal slurry pump house 3 to the coal collection unit 1.

A ventilation fan 4 is located above the ground. The ventilation fan 4 removes stale air from the underground control center 9. The underground control center 9 includes walls 40 and a ceiling 50. A computerized control panel 60 is located within the underground control center 9. The ventilation fan 4 also draws fresh air from the atmosphere above the surface 5. Fresh air is then transferred from the above-ground atmosphere to the underground control center 9 by means of a ventilation shaft (not shown). This fresh air is distributed by means of a ventilation unit (not shown) located in the underground control center, allowing mining personnel to work in a safe environment.

A power source 8 drives a drill head 12. In an embodiment, the drill head 12 is a tri-cone drill. The tri-cone drill is useful in both the mining of the coal and in reducing the particle size of the coal. In an embodiment of the present invention, the drill head 12 is hollow in a central portion thereof. This feature allows mined coal to be removed to the extendable, hollow drill shaft 13 for transport to the surface of the earth. The drill head 12 is operatively connected to the power source 8 by extendable, rotatable, hollow drill shaft 13. By "extendable" is meant that hollow pieces can be added from the underground control center to the lengthening drill shaft 13, similar to an oil drilling operation.

The drill head 12 bites into a coal seam 14 to mine coal. The drill shaft 13 is a hollow shaft. This allows the mined coal, also known as aggregate coal, to be transferred to the underground control center 9. A first stationary hydraulic shield 24 is located adjacent to the underground control center 9 and the power source 8. A second movable hydraulic shield 11 is located immediately behind the drill head 12. The second movable hydraulic shield 11 follows behind the advancing drill head 12. The second hydraulic shield 11 contains a methane barrier for preventing methane gas from penetrating into the underground control center 9.

In an embodiment, the power source 8 comprises a jet engine. The jet engine drives the drill head 12 into the underground coal seam 14 in less time than a standard combustion engine or the like.

A roof resin bolting machine 10 is movable. It travels behind the advancing second hydraulic shield 11. In an embodiment, the drilled out (mined out) coal seam is substantially circular. When viewed in a three dimensional Cartesian space, the mined out area of the coal seam is in the shape of a cylinder. The roof resin bolting machine 10 comprises at least one drill. The drill serves to bolt the roof of the mine. A resin composition is first deposited on the overhead surface of the drilled out coal seam. Bolts 30 are then deposited into the resin composition. Finally, the bolts 30 are drilled into the coal seam. This series of operations prevents collapse of the mine because it stabilizes the mined out coal seam. The operations of depositing resin, adding bolts to the resin, and drilling the bolts into the resin-coated roof of the mine are performed by mining personnel in the underground control center 9, wherein the computerized control center is employed to perform the operations.

In an alternative embodiment, the drill head 12 is a high temperature drill head (a "hot head" machine) that gasifies the coal as it is being mined. The hot-head device is a plasma torch, an electro-chemical apparatus or the like. In an embodiment, the electro-chemical apparatus includes a conversion probe; a means for spraying a mixture of air, steam and chemicals directly on the subsurface formation; and a means for producing an electric arc between the probe and the subsurface formation. Such technology is known to one of ordinary skill in the art, and as such forms no part of the present invention. The gasified coal is then readily transported to the surface for storage and ultimate transport.

In an alternative embodiment, the drill head 12 can be operated at a temperature that liquefies the coal as it is being mined. Liquefied coal is then readily removed to the surface for storage and ultimate transport.

A movable extrusion device 15 is located behind the roof resin bolting machine 10. The extrusion device 15 is filled with disposable waste which is a member selected from the group consisting of biomedical waste, discarded rubber tires, landfill waste, slaughterhouse waste, municipal waste, low grade nuclear waste and mixtures thereof. In an embodiment, the waste is discarded rubber tires. In a preferred embodiment, the waste is discarded rubber tires that have been sheared or shredded. The shearing or shredding of the tires is conducted above-ground in a shearing/shredding device 28. The waste collection unit 16 supplies disposable waste to the shearing/shredding device 28. The shearing/shredding device 28 can, in an embodiment, be a shearing device only. In an alternative embodiment, the shearing/shredding device 28 is a shredding device only. In a second alternative embodiment, the shearing/shredding device 28 is a combination of a shearing device and a shredding device. By "shearing" is meant cutting the waste material such as discarded rubber tires into pieces that are relatively large. For example, a single tire can be sheared into three or four smaller pieces. By "shredding" is meant cutting the waste material such as discarded rubber tires into pieces that are relatively small. For example, a single tire can be shredded into hundreds or thousands of smaller pieces. It is also within the scope of the present invention to pulverize the waste material, especially discarded rubber tires, into millimeter-sized particles or even smaller. Of course, such a pulverization operation is extremely energy intensive.

Sheared/shredded tires are transported to an underground extrusion device 15 by means of a hollow waste pipe 17. In an alternative embodiment, the shearing or shredding operation is conducted underground in a shearing/shredding device (not shown) within the underground control center 9. In yet another alternative embodiment, both an above-ground first shearing/shredding device 28 and an underground second shearing/shredding device (not shown) are employed in the same mining operation. Larger pieces of tire, which escaped the shearing/shredding of the first shearing/shredding device 28, are sheared or shredded immediately before entering the underground extrusion device 15.

The extrusion device 15 advances behind the roof resin bolting machine 10. It extrudes waste material 70 into the void space created by the removal of coal from the coal seam. In an embodiment, the extrusion of the waste material 70 is in a continuous manner.

In an alternative embodiment of the present invention, the extrusion device 15 is a movable spraying device. The spraying device operates in a manner similar to a spray dryer, filling the void space with waste material 70. Preferably, the waste material 70 is pulverized before entering the spraying device. In an embodiment, the spraying device operates in a manner such that the pulverized waste material 70 is blown in the direction of the underground control center.

The process of the present invention provides a unique approach to the problem of storing waste material such as discarded rubber tires. All prior art methods for disposal of discarded rubber tires are energy intensive. The present process safely and efficiently transfers discarded rubber tires to the crust of the earth, preferably deep within the crust, where they can be recycled by natural means.

The movable extrusion device 15 is operatively connected to a second power source (not shown) wherein the second power source is operatively connected to the computerized control panel 60 by electrical means. Electric cables and wires can be employed as the electrical means. Mining personnel within the underground control center 9 operate the computerized control panel 60 to advance the movable extrusion device 15.

The extrusion device 15 is operatively connected to an above-ground waste disposal unit 16 by means of a hollow transfer tubing 17. The waste disposal unit 16 is located on the surface of the earth adjacent to the entrance of the main shaft 6 of the coal mine. Preferably, the waste disposal unit 16 is located within 100 yards of the entrance to the main shaft 6 of the coal mine. Waste material suitable for burial in an underground mine is loaded into the waste disposal unit 16. It is within the scope of the present invention to compact the waste material. Thus, the waste disposal unit 16 can contain a compaction device (not shown) for compacting waste material. It is also within the scope of the present invention to shear or shred discarded rubber tires in the waste disposal unit 16 with a shearing/shredding device 28.

The above-ground waste disposal unit 16 is operatively connected to the extrusion device 15 by means of a hollow transfer tubing 17. Waste material, such as discarded rubber tires or the like, passes through the hollow transfer tubing 17 and directly into the movable extrusion device 15. In an alternative embodiment, the waste material passes through the hollow transfer tubing 17 and into the second shearing/shredding device (not shown). After being sheared or shredded in the second shearing/shredding device to obtain a sheared/shredded waste material, the material is transferred to the underground extrusion device 15. Waste material 70 is deposited in underground mined out void space by the extrusion device 15. In a preferred embodiment, the extrusion device 15 operates in such a manner as to extrude the waste material 70 in the direction of the underground control center 9.

It is within the scope of the present invention to conduct a dual mining operation wherein the method of the present invention is conducted in tandem with a traditional underground mining operation, such as long-wall mining. An underground control center is constructed in a seam of coal. In another area of the coal seam, miners work with traditional mining equipment in a ventilated region at the face of the coal seam. Mining personnel in the underground control center advance at least one drill head into a section of the coal seam. In an embodiment, that section is not occupied by miners working in a ventilated region.

In an embodiment, a traditional mining operation is retrofitted to obtain the mining operation of the present invention. A traditional mine, such as a mine employing long-wall mining technology, is retrofitted by a method comprising: (a) constructing an underground control center containing a computerized control panel; and (b) obtaining a drill head; a hollow, extendable drill shaft; and a power source. The hollow, extendable drill shaft operatively connects the drill head to the power source. The power source is operatively connected to the computerized control panel by electrical means. In an embodiment, the electrical means includes electric cables and/or wires. Mining personnel employ the computerized control panel within the underground control center to mine, collect and transfer coal. Only the underground control center is ventilated. In a preferred embodiment, a ventilation fan, a ventilation unit, and ventilation shaft are employed to provide fresh air to the underground control center, and to remove stale air.

The present invention relates to coal that is obtained by a process including locating an underground seam of coal; digging a mine shaft to reach the underground seam of coal; and constructing a control center substantially within the underground seam of coal. The control center comprises an overhead including a ceiling section and roof bolts, a plurality of walls depending from the overhead, and a floor section for receiving the plurality of walls. A computerized control panel is included inside of the underground control center. The underground control center is ventilated by employing a ventilation fan, a ventilation unit and ventilation shaft. Fresh air is supplied to the underground control center, and stale and polluted air is removed from the underground control center. The process further includes obtaining a drill head, a hollow drill shaft and a power source. The hollow drill shaft operatively connects the drill head to the power source. The power source is operatively connected to the computerized control panel by electrical means. Mining personnel enter the underground control center and operate the computerized control panel to drive the drill head into the seam of coal. Coal aggregate is obtained from the coal seam by the action of the drill head. The coal aggregate is recovered and transferred to the surface of the earth.

It is within the scope of the present invention to ventilate the mined out area of the coal seam. This can be necessary in cases such as equipment repair wherein the equipment cannot be retrieved back to the ventilated underground control center. In an alternative embodiment, mining personnel can advance through the mined out area of the coal seam in ventilated personnel carriers. In yet another alternative embodiment, the mining personnel can advance through the mined out area of the coal seam by employing individual breathing devices.

Coal gas and shale gas production are increasingly an important energy source for the United States. Annual coal bed methane production in the United States has increased significantly in the past ten years. Coal bed methane is thus an important energy source. A significant amount of natural gas produced from coal beds, carbonaceous shale and organic rich shale is secondary biogenic methane that formed under natural processes after burial, coalification and subsequent uplift and cooling. In both coal bed and shale reservoirs the majority of the gases are sorbed on the microporous matrix of the organic fraction of the rock. Relatively minor amounts of gas are sorbed on the inorganic part of the rock. The amount of gas sorbed to the organic, matter increases with increasing pressure until the surface of the organic matter is covered by a monolayer of gas molecules at which time no more gas can be sorbed to the organic matter. The coal or shale becomes saturated with respect to methane once the monolayer capacity has been reached. Methane is the dominant gas produced, but other gases including carbon dioxide, ethane, propane, butane, and hydrogen, as well as oil may be produced in varying proportions.

The present invention includes a method of recovering coal bed methane and shale gas from underground coal seams and underground shale deposits. The method of recovering gas from naturally existing subsurface formations of coal, carbonaceous shale or organic rich shale includes: locating the subsurface formation, digging a main shaft toward the subsurface formation wherein the main shaft extends into the formation; and constructing a ventilated underground control center within the subsurface formation. The underground control center is located substantially adjacent to the main shaft. The ventilated underground control center includes an overhead containing a ceiling section and roof bolts, a plurality of walls depending from the ceiling section, and a floor section for receiving the walls. The overhead, the plurality of walls and the floor section define a substantially airtight space. The control center further includes a computerized control panel.

The method further includes obtaining an extendable, rotatable, hollow drill shaft. The drill shaft has a proximal end and a distal end; and the drill shaft is operatively connected to the ventilated underground control center at its proximal end. A drill head is then obtained. The drill head is operatively connected to the drill shaft at the distal end of the drill shaft. A stationary power source is obtained. The power source is operatively connected to the computerized control panel by power source electrical means The power source is located adjacent to the ventilated underground control center. The power source is operatively connected to the drill head by means of the extendable, rotatable, hollow drill shaft.

The method further includes: constructing a stationary first hydraulic shield between the ventilated underground control center and the subsurface formation. The stationary first hydraulic shield is located substantially adjacent to the power source. A movable second hydraulic shield is obtained. The movable second hydraulic shield is located immediately behind the drill head.

The method further includes: obtaining a movable resin roof bolting machine; wherein the resin roof bolting machine is located behind the movable second hydraulic shield. The computerized control panel is operated by mining personnel to activate the power source and advance the drill head. The drill head bores into the subsurface formation.

The method further includes: obtaining an above-ground gas collection unit and a gas transfer pipe. The gas transfer pipe operatively connects the hollow drill shaft at the proximal end of the drill shaft to the above-ground gas collection unit. The hollow drill shaft collects gas from the subsurface formation. A pumping system can be employed to draw the gas from the subsurface formation and into the hollow drill shaft. The gas is transported from the hollow drill shaft to the above-ground gas collection unit. Again, a pumping system can be employed to draw the gas from the drill shaft and into the above-ground gas collection unit. The order of the apparatus located along the extendable, rotatable, hollow drill shaft beginning at its distal end is as follows: drill head, movable second hydraulic shield, movable resin roof bolting machine, stationary first hydraulic shield and stationary power source; and wherein the drill head, the movable second hydraulic shield and the movable resin roof bolting machine advance in unison into the subsurface formation when the power source is activated.

The method further includes: obtaining a movable extrusion device and positioning the extrusion device between the movable resin roof bolting machine and the stationary first hydraulic shield. The underground movable extrusion device is operatively connected to the second power source, which is operatively connected to the computerized control panel. Connecting means include electrical wires and electrical cables. An above-ground waste disposal unit is obtained. Waste material is added to the waste disposal unit. A hollow transfer tubing operatively connects the extrusion device to the waste disposal unit. Waste material is transferred from the above-ground waste disposal unit, through the hollow transfer tubing and into the underground movable extrusion device. Mining personnel located within the ventilated underground control center operate the computerized control panel to activate the movable extrusion device. Waste material is extruded into a mined out void space.

It is within the scope of the present invention to provide a coal mining operation in conjunction with a coal bed gas recovery operation. In an embodiment, a single ventilated underground control center is constructed after the digging of the mine shaft. A drill head and a hollow, extendable, rotatable drill shaft can be employed. In an embodiment, the interior of the drill shaft can be divided into concentric sections. The innermost section can transfer a coal slurry to the control center, and the outermost section can transfer coal bed gas to the control center. From the control center, the coal slurry and the coal bed gas are transferred to the respective above-ground collection units.

The long-wall method of mining coal has been employed to increase tonnage of mined coal per day in many underground mines around the globe. The long-wall method is performed in a well-ventilated underground area wherein large grinding machines, known as shearers, are placed at the face of the coal seam. The shearers continuously grind away at the face of the coal seam. The mined coal is then loaded onto movable belts or railcars for transport to the surface. In long-wall mining, a wall of coal is mined in a single slice, wherein the slice is typically about 0.6 meters to about 1 meter thick. The block of coal that is mined in the long-wall method is called a long-wall panel. The dimensions of the panel are typically about 3 kilometers to about 4 kilometers in length and about 250 meters to about 400 meters in width. The basic idea of long-wall mining is to remove substantially all of the coal from a broad face of coal, allowing the roof and overlying rock to collapse into the void behind, while at the same time maintaining a safe working space for the miners along the face of the long-wall panel. The void or cavity behind the long-wall is called the goaf or gob.

The end of the block that includes the long-wall machinery is called the face. The other end of the block is commonly one of the main travel roads of the mine. Pillars of coal are strategically left behind to support the roof of the mine. This technique is commonly called "room-and-pillar" mining, and continuous miner units are employed. Once the pillars are formed, walls or stoppings can be built between pillars to control the flow of air from a ventilation system, separating fresh airways from return airways. Man-ways are usually constructed within the walls so that miners can move between the artificially created alley-ways if there is need to inspect a certain area of the mine.

In a traditional long-wall mining operation, gate roads are driven to the back of each panel before the long-wall mining operation begins. The gate road along one side of the block is called the "maingate" and the road on the other side is called the "tailgate." The maingate can also be referred to as the headgate. Continuous miner units can be employed to construct the maingate and tailgate, as the long-wall itself is not capable of initial development. There are two possible layouts for long-wall mining. The advancing type layout allows for the gate roads, the maingate and the tailgate, to be formed as the coal face advances. Such a layout is useful in thinner seams. The retreat type layout refers to the method of forming the initial panel by driving the maingate, the tailgate and a face connecting both maingate and tailgate. Only the maingate road is formed in advance of the face; whereas the tailgate road is formed behind the coal face. The tailgate is formed by removing the stone above the coal height to form a roadway that is high enough to travel in.

In an embodiment, the present method combines long-hole mining with long-wall mining. Room-and-pillar mining is employed to develop the necessary long-wall panel for long-wall mining. Once the long-wall panel is formed, the maximum amount of coal can be removed from the coal seam. Other benefits of a method that combines long-hole mining and long-wall mining are: greater control of subsidence, substantial reduction in the amount of ventilation, greater safety for the miners, more secure escape routes for trapped miners, and burial of various types of waste materials such as used tires and the like.

In an embodiment, the method of combining long-hole mining and long-wall mining includes locating an underground seam of coal, and digging a shaft toward the underground seam of coal. Preferably, the shaft extends into the seam of coal. The method further includes constructing a ventilated underground control center substantially adjacent to the main shaft. The ventilated underground control center has a length, a width and a height. In an embodiment, the ventilated underground control center is substantially rectangular in shape, although various other shapes can be employed. The underground control center is located within the seam of coal. The underground control center is at least about 250 meters in length. In an embodiment, the underground control center can be about 400 meters in length. A computerized control panel is located within the underground control center. Also located within the control center are two sets of drill shafts. The drill shafts are extendable, rotatable, and hollow. The drill shafts have a proximal end and a distal end. The drill shafts are operatively connected to the ventilated underground control center at their proximal ends. The distance between the two sets of operatively connected drill shafts can be about 250 meters to about 400 meters. In an embodiment, the distance between the two sets of drill shafts is far enough so that a block of coal (a long-wall panel) can be economically mined in a long-wall mining operation. In an embodiment, each set of drill shafts includes about two shafts to about four shafts. In an alternative embodiment, a total of only two drill shafts are employed in the present invention, wherein the two drill shafts are separated by a distance of about 250 meters to about 400 meters.

Drill heads are operatively connected to the drill shafts, wherein each drill head is operatively connected to one drill shaft. The drill heads are operatively connected to the shafts at the distal end of the drill shafts. A power source is operatively connected to the computerized control panel by electrical means. In an embodiment, the power source is located adjacent to the ventilated underground control center. The power source is operatively connected to each drill head by means of the extendable, rotatable, hollow drill shaft.

Two sets of stationary first hydraulic shields are employed. Each stationary hydraulic shield is located between the underground control center and a drill head. Two sets of movable second hydraulic shields are employed. Each movable hydraulic shield is located between a stationary first hydraulic shield and a drill head. Mining personnel in the underground control center operate the computerized control panel to activate the movable hydraulic shields, wherein the hydraulic shields follow behind the two sets of advancing drill heads. In an embodiment, the two sets of drill heads advance through the coal seam generally in unison and generally in parallel. Two sets of movable resin roof bolting machines are employed. Each movable resin roof bolting machine is located generally directly behind a movable second hydraulic shield. Mining personnel in the underground control center operate the computerized control panel to activate the power source, advancing the two sets of drill heads into the coal seam. Mining personnel operate the computerized control panel to move the two sets of resin roof bolting machines. Resin roof bolting machines stabilize the roofs of the two sets of generally cylindrical "drilled out" holes. This is accomplished by drilling holes into the roof, filling the holes with resin and then driving roof bolts into the filled holes.

In an embodiment, the ventilated underground control center includes an overhead including a ceiling section and roof bolts, a plurality of walls depending from the ceiling section, and a floor section for receiving the walls. The overhead, the plurality of walls and the floor section define a substantially airtight space, wherein the airtight space is well ventilated.

The present method of combining long-hole mining and long-wall mining further includes: collecting the mined coal, also known as aggregate coal, for transfer to the underground control center. In an embodiment, aggregate coal passes through a mesh filter to discard larger pieces of coal before entering the hollow drill shaft. Preferably, the mesh filter is located directly behind the drill head. After larger pieces of coal are discarded, a fluid is added to the remaining coal to obtain coal particles suspended in a dispersion or slurry.

The dispersion, or slurry, of coal moves through the hollow drill shaft, toward the underground control center and ultimately to an above-ground coal collection unit by means of a pump or a series of pumps. The pump is operatively connected to the computerized control panel. In an embodiment, the pump is located within the underground control center. The dispersion, or slurry, of coal advances through the hollow, extendable drill shaft in the opposite direction of the advancing drill head. Depending on the speed of advance of the drill head, the pumping operation can be continuous or intermittent. When the pumping operation allows flow of dispersed coal particles at a speed faster than that of the advancing drill head, then the pumping operation can be continuous. Otherwise, the drilling operation is stopped, and the pumping of the coal particles occurs in a discontinuous fashion. Mining personnel in the ventilated underground control center operate the computerized control panel to advance the drill head into the coal seam; and also advance the coal dispersion, or slurry, toward the underground control center, and ultimately to the surface.

The method further includes: providing an above-ground coal collection unit; providing an above-ground coal slurry pump house; providing a transfer means, wherein the transfer means operatively connects the coal slurry pump house to the coal collection unit; and providing a coal slurry pipe, wherein the coal slurry pipe operatively connects the hollow drill shaft to the coal slurry pump house. The hollow drill shaft contains the coal slurry. The method further includes:

transporting the coal slurry to the above-ground coal slurry pump house; and removing the coal slurry from the coal slurry pump house to the coal collection unit by the transfer means.

The method of combining long-wall mining with long-hole mining further includes terminating the long-hole mining operation. In an embodiment, the drill heads travel a distance of about 1 kilometer to about 4 kilometers. It is within the scope of the present invention to advance the drill heads into the coal seam for a distance of about 5 kilometers to about 10 kilometers, or even further. After termination of the long-hole mining operation, the two sets of generally cylindrical "drilled out" holes that have been formed by the drill heads are ventilated by employing traditional mine ventilation procedures. In an embodiment, the two sets of generally cylindrical holes have a radius of about one meter to about three meters. It is within the scope of the present invention to form generally cylindrical holes that have a radius of about five meters, or even larger.

In an embodiment, ventilation of the two sets of generally cylindrical holes is accomplished by extending the ventilation system of the ventilated underground control center into the holes. It is within the scope of the present invention to ventilate the holes in smaller sections so that explosive mixtures of air and methane gas can be avoided. Techniques of ventilating underground areas such as mines are known to one of ordinary skill in the art, and as such form no part of the present invention.

After the two sets of generally cylindrical holes have been ventilated, mining personnel leave the underground control center and enter the holes. Mining personnel remove unnecessary equipment from the holes, such as the long-hole mining equipment. They can then transform the underground area into a long-wall mining operation. A block of coal useful for a long-wall mining operation is formed between the two set of ventilated, generally cylindrical holes.

Connection of the two sets of holes to form a mine face are accomplished by methods known in the art. In a preferred embodiment, room-and-pillar mining is employed to connect one set of cylindrical holes with the other set. Connection of the two sets of holes provides a newly-created long-wall panel for long-wall mining. The ventilation system is then modified to provide an in-flow of fresh air through at least one cylindrical hole in a first set of holes, and an out-flow of stale air through at least one cylindrical hole is a second set of holes. Shearers, hydraulic shields and the like are brought into the mine through one or more of the cylindrical holes; and arranged at the face of the newly-created coal panel. The long-wall mining operation is conducted in a direction toward the mine shaft rather than away from the mine shaft. Shearers advance along the coal face, with movable hydraulic shields following closely behind.

Since the long-wall mining operation is advancing toward the mine shaft, the amount of air needed to ventilate the working space for the mining personnel at the coal face becomes less and less as the work proceeds. This reduction in air flow provides for a large economical advantage over traditional long-wall mining operations.

Conducting a long-wall mining operation in the direction toward the mine shaft allows mining personnel to be closer to the main shaft as work progresses.

Conducting a long-wall mining operation in the direction toward the mine shaft allows quicker removal of coal or gas as the operation progresses.

In the long-wall mining operation of the present method, aggregate coal can be transferred to the underground control center, and eventually to the coal collection unit, by means of a conveyor system. In an embodiment, two conveyor systems can be employed, one located in each hole. In an alternative embodiment, a single conveyor system is located in one of the holes.

An advantage of performing the long-wall mining operation in the direction toward the mine shaft is that the amount of air needed to ventilate the working space becomes less and less as the mining operation advances closer to the mine shaft.

A method of recovering gas from a subsurface formation is herein disclosed. The method includes: digging a shaft toward the subsurface formation; constructing a ventilated underground control center, wherein the center is located within the subsurface formation; providing a computerized control panel, wherein the panel is located within the underground control center; providing an extendable, rotatable, hollow shaft, wherein the shaft has a proximal end and a distal end, and wherein the shaft is operatively connected to the ventilated underground control center at the proximal end; providing a hot head device, wherein the hot head device is operatively connected to the shaft at the distal end of the shaft. The method further includes providing a power source, wherein the power source is operatively connected to the computerized control panel by power source electrical means, and wherein the power source is operatively connected to the hot head device by the extendable, rotatable, hollow shaft; providing a movable hydraulic shield, wherein the shield is located behind the hot head device; providing a movable resin roof bolting machine, wherein the bolting machine is located behind the movable hydraulic shield; operating the computerized control panel, wherein the power source activates the hot head device, and wherein the hot head device vaporizes the subsurface formation to obtain a gas; and recovering the gas.

In an embodiment, the step of recovering the gas includes pumping the gas through the hollow shaft to an above-ground gas collection unit.

The method further includes: providing a movable waste extrusion device, wherein the waste extrusion device is located behind the movable resin roof bolting machine. The waste extrusion device is connected to a second power source, and the second power source is operatively connected to the computerized control panel. The method further includes: providing waste material; providing an above-ground waste disposal unit; adding the waste material to the above-ground waste disposal unit; providing a hollow transfer tubing, wherein the hollow transfer tubing operatively connects the underground movable waste extrusion device to the above-ground waste disposal unit; moving the waste material from the above-ground waste disposal unit to the underground movable waste extrusion device by employing the hollow transfer tubing; and operating the computerized control panel to extrude waste material into a mined-out space.

In an embodiment, the subsurface formation is an underground coal seam or an underground shale deposit. The waste material is bio-medical waste, used tires, landfill waste, slaughterhouse waste, municipal waste, low grade nuclear waste, automobile junkyards or mixtures thereof.

In an embodiment, the present invention relates to a method of providing an unlimited underground source of natural gas by allowing the waste material to produce a waste-generated gas. The waste-generated gas includes natural gas as well as other valuable organic and non-organic chemicals. The waste-generated gas is emitted from the underground waste material for a substantially indefinite amount of time. Mined-out space formed by removal of a non-renewable energy source is converted into a source of substantially renewable energy. It is well-known that man-made landfills are the largest anthropogenic source of methane gas on the planet. The present invention removes landfills from the surface of the earth to a mined-out space underground where the waste-generated gas is readily recovered for energy use. An above-ground gas collection unit is employed to collect the waste-generated gas.

In an embodiment, the waste-generated gas is collected by providing a gas transfer pipe, wherein the gas transfer pipe operatively connects the above-ground gas collection unit to the mined-out space containing the waste material and the waste-generated gas; and transporting the waste-generated gas from the underground mined-out space to the above-ground gas collection unit.

In an embodiment, the present invention relates to an apparatus for recovering gas from a subsurface formation. The apparatus includes a ventilated underground control center, wherein the center is located within the subsurface formation; a computerized control panel, wherein the panel is located within the underground control center; and an extendable, rotatable, hollow shaft; wherein the shaft has a proximal end and a distal end. The shaft is operatively connected to the ventilated underground control center at the proximal end. The apparatus further includes a hot head device. The hot head device is operatively connected to the shaft at the distal end of the shaft. The apparatus further includes a power source, wherein the power source is operatively connected to the computerized control panel by power source electrical means. The power source is operatively connected to the hot head device by the extendable, rotatable, hollow shaft. The apparatus further includes a movable hydraulic shield, wherein the shield is located behind the hot head device; a movable resin roof bolting machine, wherein the bolting machine is located behind the movable hydraulic shield; and an above-ground gas collection unit. The apparatus further includes a pump unit for pumping the gas through the hollow shaft to the above-ground gas collection unit.

While the invention has been described by specific embodiments, there is no intent to limit the inventive concept except as set forth in the following claims.

We claim:

1. A method of storing waste material comprising:

digging a shaft toward a subterranean formation;

constructing a ventilated underground control center, wherein the center is located within the subterranean formation;

providing a computerized control panel, wherein the panel is located within the underground control center;

providing a drill pipe, wherein the pipe is extendable, wherein the pipe has a proximal end and a distal end, and wherein the pipe is operatively connected to the ventilated underground control center at the proximal end;

providing a drill head, wherein the drill head is operatively connected to the pipe at the distal end of the pipe;

providing a power source, wherein the power source is operatively connected to the computerized control panel by power source electrical means, and wherein the power source is operatively connected to the drill head by the drill pipe;

providing a movable hydraulic shield, wherein the shield is located behind the drill head;

providing a movable resin roof bolting machine, wherein the bolting machine is located behind the movable hydraulic shield; and operating the computerized control panel to perform the tasks of advancing the drill head to obtain a mined-out space; advancing the movable hydraulic shield, operating the movable resin roof bolting machine to obtain a stabilized mine roof and filling the mined-out space with the waste material.

2. The method according to claim 1 wherein the step of filling the mined-out space is accomplished by:

providing a movable waste extrusion device, wherein the waste extrusion device is located behind the movable resin roof bolting machine, wherein the waste extrusion device is connected to a second power source, and wherein the second power source is operatively connected to the computerized control panel;

providing waste material;

providing an above-ground waste disposal unit;

adding the waste material to the above-ground waste disposal unit;

providing a hollow transfer tubing, wherein the hollow transfer tubing operatively connects the underground movable waste extrusion device to the above-ground waste disposal unit;

moving the waste material from the above-ground waste disposal unit to the underground movable waste extrusion device by employing the hollow transfer tubing; and operating the computerized control panel wherein waste material is extruded into the mined-out space.

3. The method according to claim 1 wherein the subterranean formation is a member selected from the group consisting of an underground coal seam and an underground shale deposit.

4. The method according to claim 1 wherein the waste material is a member selected from the group consisting of bio-medical waste, used tires, landfill waste, slaughterhouse waste, municipal waste, low grade nuclear waste and mixtures thereof.

5. The method according to claim 1 further comprising:

allowing the waste material to produce a waste-generated gas; and recovering the waste-generated gas.

6. The method according to claim 5 wherein the step of recovering the waste-generated gas comprises:

providing an above-ground gas collection unit;

providing a gas transfer pipe, wherein the gas transfer pipe operatively connects the above-ground gas collection unit to the mined-out space containing the waste material and the waste-generated gas; and transporting the waste-generated gas from the underground mined-out space to the above-ground gas collection unit.

7. An apparatus for storing waste material in a subterranean formation comprising:

a ventilated underground control center, wherein the center is located within the subterranean formation;

a computerized control panel, wherein the panel is located within the underground control center;

a drill pipe, wherein the drill pipe is extendable, wherein the drill pipe has a proximal end and a distal end, and wherein the drill pipe is operatively connected to the ventilated underground control center at the proximal end;

a drill head, wherein the drill head is operatively connected to the drill pipe at the distal end of the drill pipe;

a power source, wherein the power source is operatively connected to the computerized control panel by power source electrical means, and wherein the power source is operatively connected to the drill head by the drill pipe;

a movable hydraulic shield, wherein the shield is located behind the drill head;

a movable resin roof bolting machine, wherein the bolting machine is located behind the movable hydraulic shield; and a movable waste extrusion device, wherein the waste extrusion device is located behind the movable resin roof bolting machine, wherein the waste extrusion device is connected to a second power source, and wherein the second power source is operatively connected to the computerized control panel.

8. The apparatus according to claim 7 wherein the subterranean formation is a member selected from the group consisting of an underground coal seam and an underground shale deposit.

* * * * *